US008252124B2

(12) United States Patent
Koeda et al.

(10) Patent No.: US 8,252,124 B2
(45) Date of Patent: Aug. 28, 2012

(54) POWDER MAGNETIC CORE AND METHOD FOR MANUFACTURING THE SAME

(75) Inventors: Masahito Koeda, Tokyo (JP); Tomofumi Kuroda, Tokyo (JP); Tomokazu Ishikura, Tokyo (JP); Akihiro Harada, Tokyo (JP); Hiroyuki Ono, Tokyo (JP); Osamu Kido, Tokyo (JP); Satoko Ueda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/046,307

(22) Filed: Mar. 11, 2011

(65) Prior Publication Data

US 2011/0227679 A1 Sep. 22, 2011

(30) Foreign Application Priority Data

Mar. 18, 2010 (JP) ..... 2010-063148
Jul. 9, 2010 (JP) ..... 2010-156772

(51) Int. Cl.
*H01F 1/147* (2006.01)
*H01F 1/22* (2006.01)

(52) U.S. Cl. ..... 148/306; 148/122; 75/348; 75/228

(58) Field of Classification Search ..... None
See application file for complete search history.

(56) References Cited

U.S. PATENT DOCUMENTS 7,351,355 B2 * 4/2008 Kakuya et al. ..... 252/178
2008/0314839 A1 * 12/2008 Uegami et al. ..... 210/722
2010/0047180 A1 * 2/2010 Zeng et al. ..... 424/9.32

FOREIGN PATENT DOCUMENTS

JP A-2008-294411 12/2008

* cited by examiner

*Primary Examiner* — John Sheehan
(74) *Attorney, Agent, or Firm* — Oliff & Berridge, PLC

(57) ABSTRACT

The present invention provides a powder magnetic core low in the loss and high in the saturation magnetic flux density and a method for manufacturing the same. More specifically, the present invention provides a powder magnetic core that comprises a soft magnetic metal powder having an average particle size (D50) of 0.5 to 5 μm, a half width of diffraction peak in a <110> direction of α-Fe as measured by X-ray powder diffraction of 0.2 to 5.0°, and an Fe content of 97.0% by mass or more, the core having an oxygen content of 2.0% by mass or more.

10 Claims, 1 Drawing Sheet

Frequency Dependency of the Core Loss

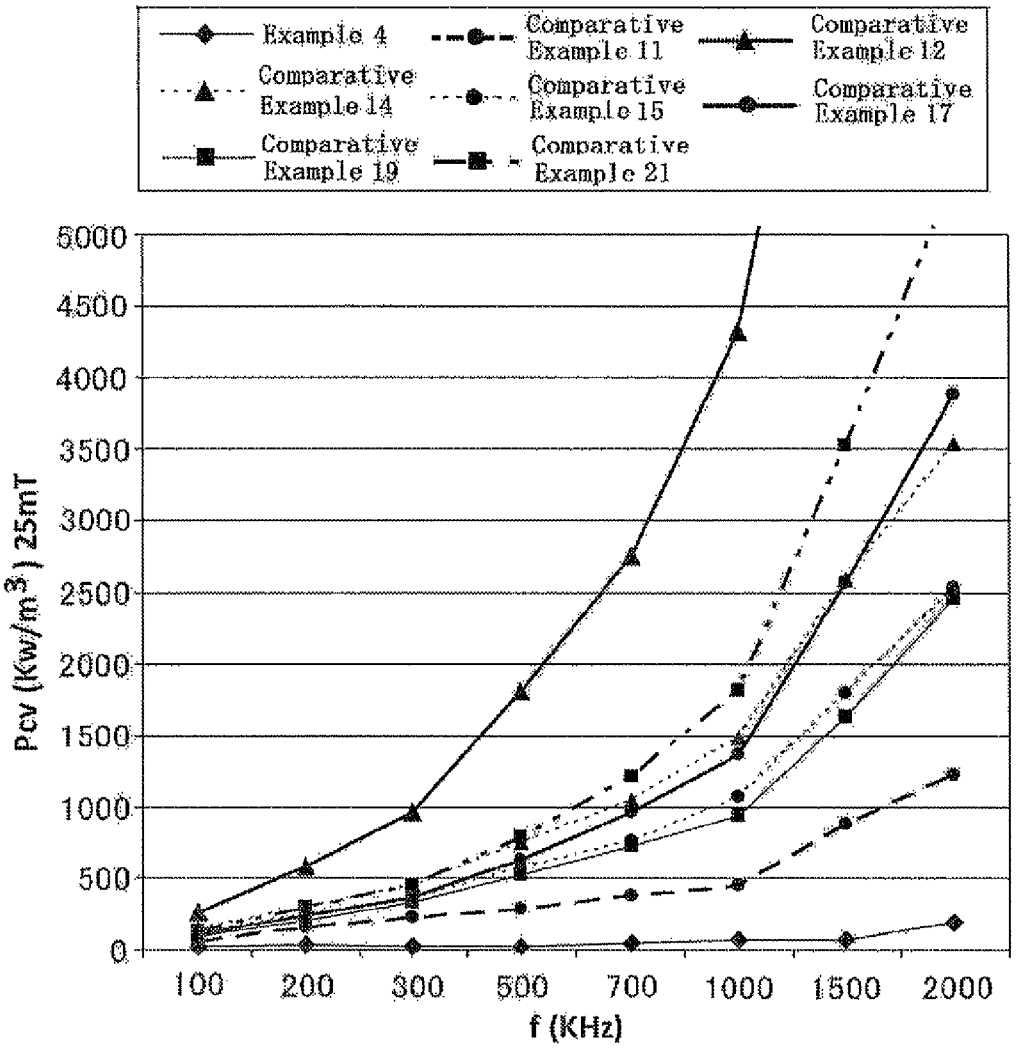
Frequency Dependency of the Core Loss

POWDER MAGNETIC CORE AND METHOD FOR MANUFACTURING THE SAME

CROSS-REFERENCES TO RELATED APPLICATIONS

The present application relates to and claims priority from Japanese Patent Application No. 2010-063148, filed with the Japan Patent Office on Mar. 18, 2010 and Japanese Patent Application No. 2010-156772, filed with the Japan Patent Office on Jul. 9, 2010, the entire disclosure of which is incorporated herein by reference.

BACKGROUND OF THE INVENTION

1. Field of the Invention

The present invention relates to a powder magnetic core and a manufacturing method thereof.

2. Description of the Related Art

Recently, low consumption power and high efficiency are in demand in electronics, information, communication devices, etc. and a trend toward a low carbon society is stronger than ever. Accordingly, also in power circuits mounted on electronics, information, communication devices, etc., a reduction in energy loss and an improvement in power efficiency are in demand. In this connection, the magnetic core of a magnetic element used in a power circuit is required to be low in the core loss (magnetic core loss). When the core loss is reduced, the loss in electric power energy is smaller, and thereby, high efficiency and energy saving can be realized.

As such magnetic cores, soft ferrite cores have been broadly used from the viewpoint of inexpensiveness and low loss. Furthermore, also powder magnetic cores obtained by compression molding composite magnetic materials obtained by adding a binder such as a resin to a soft magnetic metal powder are frequently used.

Recently, as a power voltage is lowered, use of a larger current in a power circuit is promoted, thereby a current that flows into a magnetic element tends to increase. A high saturation magnetic flux density is necessary for the magnetic core of a magnetic element demanded to respond to a large current. A soft ferrite core is low in saturation magnetic flux density; accordingly, a magnetic core used in a magnetic element demanded to respond to a large current is a powder magnetic core.

Examples of metal soft magnetic powders used in the powder magnetic cores include iron-based crystalline soft magnetic alloy powders such as Fe powders and Fe—Si based alloy powders. The iron loss of the powder magnetic core is largely divided into hysteresis loss and eddy current loss. When the hysteresis loss is further desired to be less than that of the powder magnetic core formed of the Fe-based crystalline soft magnetic powder, amorphous soft magnetic alloy powder or nanocrystal soft magnetic alloy powder having nano-size micro-crystals is used.

Examples of methods for obtaining amorphous soft magnetic alloy powders or nanocrystal soft magnetic alloy powders include a method where a quenched ribbon obtained by a single roll technique etc. is mechanically pulverized, and an atomization method. According to the atomization method, a powder can be directly obtained without going through a pulverization step. However, the range of its composition is limited by the quenching speed of an atomizer. In general, the saturation magnetic flux density is lower than that of the quenched ribbon. The quenched ribbon can generally provide a material with a higher saturation magnetic flux density than the atomized powder.

To obtain a powder magnetic core with a low hysteresis loss and a high saturation magnetic flux density, technique relating to a powder magnetic core formed of an iron-based nanocrystal magnetic powder is disclosed, for example, in Patent Document 1. A soft magnetic powder having a matrix phase structure in which crystal particles with a particle size of 60 nm or less are dispersed at a volume fraction of 30% or more in the amorphous phase as well as having an amorphous layer on the surface of the matrix phase structure is compacted and thereafter, the compact is heated to manufacture a powder magnetic core having a soft magnetic powder of a microcrystal structure having a matrix phase structure where crystal particles with a particle size of 60 nm or less are dispersed at a volume fraction of 30% or more in the amorphous phase.

[Patent Document 1] Japanese Patent Laid-Open No. 2008-294411

SUMMARY OF THE INVENTION

In recent years, since power circuits can be down-sized, a region of a driving frequency of switching power sources is shifting from several hundreds kHz to a region of MHz, and, also in the region of MHz, powder magnetic cores having excellent characteristics are in demand. In magnetic cores of magnetic elements used in the MHz region, soft ferrite cores cheap and small in the magnetic core loss are frequently used. However, as described above, the soft ferrite cores are low in the saturation magnetic flux density and cannot meet a large current drive.

According to a conventional technology disclosed in Patent Document 1, a powder magnetic core having a loss as much as or less than that of a powder magnetic core that uses an iron-based amorphous soft magnetic powder and yet having a high magnetic flux density is stated to be obtained. However, by studying hard, the present inventors found that the saturation magnetic flux density thereof was not yet sufficient. Furthermore, in the conventional powder magnetic cores, there occurs a large problem that in a high frequency band (MHz region), the core loss rapidly increases (high frequency dependency; the characteristics in high frequency bands are insufficient).

Furthermore, also from the viewpoint of a method for manufacturing powder magnetic cores, the conventional method has a room for improvement. That is, when powder magnetic cores used in high frequency bands (several MHz) are manufactured, in order to suppress the eddy current loss, a fine powder having an average particle size (D50) of 5 μm or less is desired to use. However, it is difficult to directly obtain a fine powder having an average particle size (D50) of about several micrometers by pulverization of a quenched ribbon, etc. Although a powder having an average particle size (D50) of 5 μm or less can be obtained by a known classification method, it is poor in yield and uneconomical. Furthermore, when the quenched ribbon is pulverized, a coercive force of the magnetic powder increases, and thus a problem is that a powder magnetic core small in the hysteresis loss cannot be obtained with such a powder.

The present invention has been made in view of the foregoing problems, and an object of the present invention is to provide a powder magnetic core capable of realizing low loss and high saturation magnetic flux density, and a method for manufacturing the same.

The present inventors have studied hard to solve the problems and have found that when a powder magnetic core having an oxygen content of 2.0% by mass or more is produced with a soft magnetic metal powder that has an average particle size (D50) of 0.5 to 5 μm, a half width of diffraction peak in a <110> direction of α-Fe as measured by X-ray powder diffraction of 0.2 to 5.0°, and an Fe content of 97.0% by mass or more, the foregoing problems can be solved, and thereby, the present invention has been completed.

That is, the powder magnetic core of the present invention comprises a soft magnetic metal powder having an average particle size (D50) of 0.5 to 5 μm, the half width of diffraction peak in the <110> direction of α-Fe as measured by X-ray powder diffraction of 0.2 to 5.0°, and the Fe content of 97.0% by mass or more, wherein the oxygen content is 2.0% by mass or more.

The present inventors have found, as a result of measuring characteristics of the powder magnetic core having such a constitution, that the core loss can be largely reduced more than ever. The core loss of a powder magnetic core is largely divided into an eddy current loss and a hysteresis loss. Conventionally, the eddy current loss has been considered to be larger in proportion to the square of a frequency. Accordingly, in the case of a powder magnetic core that is used in a high frequency band (MHz region), it is important to suppress the eddy current loss thereof. When the powder magnetic core is heated, there is a concern that insulation between metal magnetic particles given by a binder resin becomes insufficient (in general, heat treatment decreases the electrical resistivity of the core), resulting in a higher eddy current loss. Furthermore, heat treatment in an oxidizing atmosphere, in addition to the deterioration of the insulating property, raises a concern of an increase in hysteresis loss owing to an increase in iron oxide. However, surprisingly, it has been found according to the study of the present inventors that when a powder magnetic core having the above constitution of the oxygen content of 2.0% by mass or more is formed by heat treatment in an oxidizing atmosphere, the core loss can be reduced. A detailed reason for that is not yet clear. However, it is assumed that irrespective of an increase in the eddy current loss and hysteresis loss, the loss as a whole core loss can be largely reduced (However, the operation, etc. of the present invention is not restricted thereto.).

It is preferred for the soft magnetic metal powder to further comprise carbon, and a carbon content in the soft magnetic metal powder is more preferably from 0.1 to 1.5% by mass. When the carbon content is set to 0.1 to 1.5% by mass, a powder magnetic core high in the saturation magnetic flux density and low in the loss can be obtained.

The saturation magnetization σs of the soft magnetic metal powder is preferably 200 emu/g or more. Thereby, the powder magnetic core higher in the saturation magnetic flux density can be obtained.

A surface of the soft magnetic metal powder is preferably at least partially coated with an insulating resin. A thickness of the coating due to the insulating resin is preferably from 10 to 1000 nm. Coating of the insulating resin allows for better moldability, handleability, and productivity of the soft magnetic metal powder, as demonstrated by easier handling in air during manufacture. Furthermore, by containing the insulating resin, an insulating property between particles is enhanced, thereby a path through which the eddy current flows is shut, and thereby the eddy current loss is more reduced. In a coating layer formed with the insulating resin, an Fe component such as iron oxide (for example, FeO, $Fe_2O_3$, $Fe_3O_4$) may be partially contained. Thereby, the insulating property, handleability and productivity of the powder magnetic cores can be further enhanced.

Herein, according to the findings of the present inventors, it has been found preferable that a soft magnetic metal powder (each of particles thereof) has a vortex magnetization distribution. The soft magnetic metal powder having the vortex magnetization distribution is smaller in the magnetic anisotropy than the soft magnetic metal powder that does not have the vortex magnetization distribution (have a non-vortex magnetization distribution), resulting in a lower coercive force, whereby the hysteresis loss can be made even smaller (however, the advantage is not restricted thereto). The "vortex magnetization distribution" of the soft magnetic metal powder means a structure where a circulating magnetic field is formed inside a particle (see, for example, Katuaki Sato, "Jisei to Supin Erekutoronikusu Nyumon (Introduction to Magnetism and Spin Electronics)", and Professional Group of Spin Electronics of Japan Society of Applied Physics, "Supin Erekutoronikusu Nyuumon Semina (Introductory Seminar to Spin Electronics)", Dec. 8, 2005, Text p. 1 to p. 11). Even when a plurality of different vortexes is formed inside of the soft magnetic metal powder (each of particles thereof), it is contained in the "vortex magnetization distribution,"

The powder magnetic core of the present invention can be formed into a powder magnetic core having the electrical resistivity of 0.05 Ωcm or more. The powder magnetic core like this can further reduce the core loss in high frequency bands; accordingly, it can be preferably used also as a magnetic core of electronic devices large in electronic load and severe in usage environment.

A method for manufacturing a powder magnetic core of the present invention comprises a step of heat treating a soft magnetic metal powder having an average particle size (D50) of 0.5 to 5 μm, the half width of diffraction peak in the <110> direction of α-Fe as measured by X-ray powder diffraction of 0.2 to 5.0°, and the Fe content of 97.0% by mass or more at a temperature less than 250° C. under an atmosphere containing oxygen. When the foregoing soft magnetic metal powder is heated under the conditions of a heat treatment temperature less than 250° C. under an atmosphere containing oxygen, a powder magnetic core having the oxygen content of 2.0% by mass or more can be produced with good controllability.

According to the present invention, a powder magnetic core low in the loss and high in the saturation magnetic flux density and a method for manufacturing the same can be provided.

BRIEF DESCRIPTION OF THE DRAWING

FIG. 1 is a graph illustrating the frequency dependency of the core loss of the powder magnetic cores in Examples and Comparative Examples.

DETAILED DESCRIPTION OF THE PREFERRED EMBODIMENTS

In what follows, embodiments of the present invention will be described. The embodiments shown below are examples for describing the present invention and the present invention is not limited only to the embodiments.

A powder magnetic core of the present invention comprises a soft magnetic metal powder having an average particle size (D50) of 0.5 to 5 μm, the half width of diffraction peak in the <110> direction of α-Fe as measured by X-ray powder diffraction of 0.2 to 5.0°, and the Fe content of 97.0% by mass or more, wherein the oxygen content is 2.0% by mass or more.

(Soft Magnetic Metal Powder)

An average particle size (D50) of the soft magnetic metal powder is from 0.5 to 5 μm, and preferably from 1.0 to 3.0 μm. If the average particle size (D50) is less than 0.5 μm, the dispersibility of a binder resin and the soft magnetic metal powder is poor, resulting in an increase in the eddy current loss. Furthermore, the handleability during the manufacturing step deteriorates, resulting in reduction in the productivity. If the average particle size (D50) is more than 5 μm, the eddy current loss is large, making it impossible to obtain a low loss powder magnetic core.

In the present specification, unless otherwise specified a particle size means a median diameter in an accumulated distribution-based on volume. The average particle size (D50) can be determined according to a measurement method described in Examples described below.

The half width of diffraction peak in the <110> direction of α-Fe as measured by X-ray powder diffraction of the soft magnetic metal powder is from 0.2 to 5.0° and preferably from 0.5 to 1.0°. If the half value width is less than 0.2°, a crystallite size of the soft magnetic metal powder is excessively large, resulting in large hysteresis loss of the powder magnetic core. It is difficult to obtain a soft magnetic metal powder having a half value width of the diffraction line larger than 5.0°. The half value width of the diffraction line can be obtained according to a measurement method described in Examples described below.

The soft magnetic metal powder has crystallites having an average crystallite size preferably of 2 to 100 nm and more preferably of 5 to 20 nm in the particle. A powder magnetic core that uses a magnetic powder having such nanocrystallites can more securely exhibit a reducing effect on the magnetic loss, in particular, a reducing effect on the hysteresis loss. From this viewpoint, an average crystallite size of the nanocrystallites is preferably 20 nm or less. The average crystallite size of crystallites generally tends to be larger when the soft magnetic metal powder is heated.

The Fe content (including pure iron and iron containing inevitable impurities) of the soft magnetic metal powder is 97.0% by mass or more and preferably 98.0% by mass or more. If the Fe content is less than 97.0% by mass, the saturation magnetization decreases. A method for manufacturing the soft magnetic metal powder is not particularly restricted and the powder can be manufactured by known methods. Among these, a carbonyl method is preferable. Using the carbonyl method, a soft magnetic metal powder having the preferred composition, particle size and crystallites can be obtained with ease and at low cost. That is, the soft magnetic metal powder is preferably an iron powder (non-reduced carbonyl iron powder or the like) obtainable by a carbonyl method. According to the carbonyl method, after iron pentacarbonyl is obtainable by reacting iron (Fe) with carbon monoxide, the iron pentacarbonyl is distilled and pyrolyzed to obtain a carbonyl iron powder.

In the present invention, as a magnetic material, the abovementioned iron powder, preferably, the abovementioned non-reduced carbonyl iron powder is used.

The soft magnetic metal powder may further comprise carbon (C). A carbon content is not particularly limited, but is preferably from 0.1 to 1.5% by mass, and more preferably from 0.5 to 1.0% by mass, relative to the soft magnetic metal powder used. By setting the carbon content to the range, a powder magnetic core high in the saturation magnetic flux density and low in the loss can be obtained. Furthermore, if the soft magnetic metal powder is manufactured according to the carbonyl method, in some cases, a certain amount of carbon is contained in the resulting carbonyl iron powder (non-reduced carbonyl iron powder or the like). Even in such a case, by setting the carbon content of the soft magnetic metal powder to the above range, the core loss of the powder magnetic core can be further reduced, and the saturation magnetic flux density can be made further higher.

The saturation magnetization σs of the soft magnetic metal powder is preferably 200 emu/g or more and more preferably 204 emu/g or more. If a soft magnetic metal powder having such saturation magnetization σs is used, a powder magnetic core having high saturation magnetic flux density can be obtained.

The soft magnetic metal powder preferably has a vortex magnetization distribution. As mentioned above, the soft magnetic metal powder having the vortex magnetization distribution is smaller in the magnetic anisotropy than the soft magnetic metal powder that does not have the vortex magnetization distribution (having a non-vortex magnetization distribution), and as a result, the coercive force can be more lowered, which in turn an advantage is that the hysteresis loss can be made further smaller (however, the advantage is not limited thereto.).

(Composite Magnetic Material)

The powder magnetic core of the present invention preferably contains a composite magnetic material obtainable by coating a surface of a soft magnetic metal powder partially or entirely with an insulating resin. By forming such a composite magnetic material, an insulating property between particles can be improved and the productivity during molding the powder magnetic cores can be improved. A material of the insulating resin is not particularly restricted and is appropriately selected in accordance with necessary characteristics. Specific examples thereof may include insulating resins such as a silicone resin, a phenol resin, an acrylic resin and an epoxy resin. These may be used alone or in combination of two or more thereof.

A blending amount of the insulating resin is not particularly limited, but is preferably from 0.1 to 5% by mass, and more preferably from 1.0 to 4.5% by mass, relative to the soft magnetic metal powder used. By setting the blending amount of the insulating resin to the range, an appropriate insulating property is obtained and suitable direct current superposition characteristics can be obtained.

When the powder magnetic core of the present invention contains the insulating resin, a crosslinking agent may be further contained. When the crosslinking agent is contained, the mechanical strength can be further improved without degrading the magnetic characteristics of the powder magnetic core. The kind of the crosslinking agent is not particularly limited and can be appropriately and suitably selected in accordance with the kind of the insulating resin used and characteristics desired for the powder magnetic core. As the crosslinking agent, for example, an organotitanium compound can be used. A content of the crosslinking agent is not particularly limited, but is preferably from 10 to 40 parts by mass based on 100 parts by mass of the insulating resin.

The powder magnetic core of the present invention preferably further comprises a lubricant. The kind of the lubricant is not particularly limited, and examples thereof may include zinc stearate, aluminum stearate, barium stearate, magnesium stearate, calcium stearate, and strontium stearate. Among these, zinc stearate is more preferred from the viewpoint of an improvement in the density of a molded body, that is, an improvement in the saturation magnetic flux density of the powder magnetic core.

A blending amount of the lubricant is not particularly limited, but is preferably from 0.1 to 1.0% by mass and more preferably from 0.2 to 0.8% by mass, relative to the soft magnetic metal powder used. By setting the blending amount of the lubricant to the range, a metal mold can be effectively inhibited from wearing during molding the soft magnetic metal powder and the molding density can be made to have a more suitable range.

The powder magnetic core of the present invention, as required, may be blended with an inorganic material such as $SiO_2$ and $Al_2O_3$ and a mold aid. These may be known additives.

As a preferable aspect of the powder magnetic core of the present invention, a powder magnetic core having an electrical resistivity of 0.05 Ωcm or more can be formed. Such a powder magnetic core can further reduce the core loss in a high frequency band and thereby can be suitably used as a magnetic core of electronic devices large in electronic load and severe in a use environment.

(Method for Manufacturing Powder Magnetic Core)

A method for manufacturing a powder magnetic core of the present invention comprises a step of heat treating a powder magnetic core including a soft magnetic metal powder having an average particle size (D50) of 0.5 to 5 μm, a half width of diffraction peak in a <110> direction of α-Fe as measured by X-ray powder diffraction of 0.2 to 5.0°, and an Fe content of 97.0% by mass or more at a temperature less than 250° C. under an atmosphere containing oxygen. By, in the heat treatment step, heating the foregoing powder magnetic core including the soft magnetic metal powder at a temperature less than 250° C. under an atmosphere containing oxygen, a powder magnetic core having the oxygen content of 2.0% by mass or more can be manufactured with good controllability.

The composition and the like of the atmosphere in the heat treatment is not particularly limited as long as it contains oxygen. The atmosphere may be, for example, air. An oxygen content in the heat treatment atmosphere is not particularly limited, and can be appropriately selected in accordance with a target value of the oxygen content of the powder magnetic core, but is preferably from 0.001 to 30% by volume and more preferably from 15 to 25% by volume.

The heat treatment temperature is preferably less than 250° C. and more preferably 150° C. or more and 200° C. or less. By setting the heat treatment temperature to the range, the powder magnetic core can be moderately oxidized with good controllability, and as a result, the oxygen content of the powder magnetic core can be readily controlled to 2.0% by mass or more. A heat treatment time is not particularly limited, and can be appropriately selected in accordance with the heat treatment temperature, desired characteristics of the powder magnetic core and the like. For example, when the heat treatment temperature is 150° C. or more and less than 250° C., it is preferred to be about 15 to 120 minutes.

Furthermore, before the heat treatment, as required, blending of various kinds of additives or compression molding can be conducted. For example, when the powder magnetic core further contains the insulating resin and other additives, before the heat treatment step, a step of blending the soft magnetic metal powder and the insulating resin is preferably conducted. A step of compression molding the mixture obtained by the blending step is preferred to be further included. Then, by heat treating a molded body obtained by the compression molding step, the insulating resin in the molded body is cured and thereby a powder magnetic core can be obtained. That is, by heat treating a soft magnetic material containing a soft magnetic metal powder, and, as required, the insulating resin and other additives, a powder magnetic core can be obtained.

The soft magnetic metal powder and the insulating resin are preferably mixed with a stirring and mixing device such as a pressure kneader or a ball mill. A mixing condition is not particularly limited but it is preferred to mix at room temperature for 20 to 60 minutes. By setting the mixing condition, a soft magnetic metal powder coated with an insulating resin can be more efficiently obtained.

From the viewpoint of improving the dispersibility between the soft magnetic metal powder, the insulating resin and the like, the mixing step is preferably conducted in the presence of an organic solvent. A specific mixing condition is that the mixing is conducted at room temperature for 20 to 60 minutes to obtain a mixture, the resulting mixture is dried at a temperature of about 50 to 100° C. for 10 minutes to 10 hours, and thereafter, the organic solvent is preferably volatilized or removed. Thereby, the soft magnetic metal powder coated with the insulating resin can be more efficiently obtained. Examples of the organic solvents may include oils such as mineral oils, synthetic oils, and plant oils, and organic solvents such as acetone and alcohol, and are not particularly restricted thereto.

In the compression molding step, the soft magnetic metal powder (or the mixture) is packed in a molding metal mold of a press machine, followed by compression molding by pressurizing the soft magnetic metal powder, whereby a molded body is obtainable. The molding condition in the compression molding is not particularly limited and can be appropriately determined in accordance with the bulk density, the viscosity, a desired shape of a powder magnetic core, dimensions, density and the like. The molding pressure of the powder magnetic core is not particularly limited and is usually, for example, about 4 to 12 tonf/cm$^2$, and preferably about 6 to 8 tonf/cm$^2$, and a time holding under the maximum pressure is about 0.1 seconds to 1 minute.

As required, before the heat treatment step, an anti-rusting treatment step of subjecting anti-rusting treatment to the powder magnetic core may be further conducted. As the anti-rusting treatment, known methods can be adopted, and for example, a method of spray coating an epoxy resin or the like can be adopted. For example, a film thickness due to the spray coating is not particularly limited but is usually about several tens micrometers. When the mixing step and compression molding step are conducted, the anti-rusting step is preferably conducted after these steps and before the heat treatment step.

EXAMPLES

In what follows, the present invention will be described in more detail with reference to Examples. However, the present invention is not limited thereto.

Raw material powders used in the respective Examples and respective Comparative Examples are as follows.

(1) Nanocrystal Carbonyl Iron Powder

According to a carbonyl method, Fe carbonyl (manufactured by Strem Chemical Inc., obtained via Kanto Kagaku) was sprayed into a decomposition tower kept at 240° C. to obtain a nanocrystal carbonyl iron powder. The value of saturation magnetization σs thereof was 204 emu/g.

(2) Non-Nanocrystal Carbonyl Iron Powder

The nanocrystal carbonyl iron powder obtained according the method described above was heat treated in a hydrogen atmosphere and thereby a non-nanocrystal carbonyl iron powder was prepared. The value of saturation magnetization σs thereof was 210 emu/g.

(3) Atomized Iron Powder

Atomized iron powders shown in Table 2 were prepared according to an atomization method. Specifically, the atomized iron powders were prepared according to a known atomization method and classified according to a known method. The value of the saturation magnetization σs thereof was 206 emu/g.

(4) Reduced Iron Powder

A reduced iron powder was prepared according to a known hydrogen reduction method. The value of the saturation magnetization σs thereof was 206 emu/g.

(5) Atomized Fe—Ni Based Powder

Atomized Fe—Ni based powders shown in Table 2 were prepared according to the atomization method. Specifically, the atomized Fe—Ni powders were prepared according to a known atomization method and classified according to a known method. The value of the saturation magnetization σs thereof was 129 emu/g.

(6) Atomized Fe—Si Based Powder

Atomized Fe—Si based powders shown in Table 2 were prepared according to the atomization method. Specifically, the atomized Fe—Si based powders were prepared according to a known atomization method and classified according to a known method. The value of the saturation magnetization σs thereof was 204 emu/g.

(7) Atomized Fe—Si—Al Based Powder

An atomized Fe—Si—Al based powder shown in Table 2 was prepared according to the atomization method. Specifically, the atomized Fe—Si—Al based powder was prepared according to a known atomization method. The value of the saturation magnetization σs thereof was 116 emu/g.

(Number-Average Particle Size)

The average particle sizes (D50) of these raw material powders were measured with a laser diffraction type dry particle size analyzer (trade name: HELOS System, manufactured by Sympatec GmbH.).

(Half Width of Diffraction Peak in the <110> Direction of α-Fe as Measured by X-Ray Powder Diffraction)

X-ray diffraction patterns of these raw material powders were measured with a full-automatic multi-purpose X-ray diffractometer (X'Pert PRO MPD, HYPERLINK "http://www.panalytical.com/xpertprompd", manufactured by PANalytical B.V.). Measurement conditions were set to an X-ray tube of Cu, a tube voltage of 45 kV, a tube current of 40 mA, a step size of 0.0167°, and a scan speed of 0.01°/second. Furthermore, conditions of an optical system on an incident side were set to 10 μm of a Ni filter, ½° of a solar slit, 10 μm of a mask and 1° of a scatter prevention slit, and, conditions of an optical system on a light receiving side were set to 20 μm of a Ni filter, 5.5 mm of a scatter prevention slit, and 0.04° of a solar slit. The half width of diffraction peak in the <110> direction of α-Fe was calculated by conducting the peak fitting-based on a Voigt function.

(Saturation Magnetization)

The saturation magnetization σs of the raw material powder was calculated with a magnetization characteristics evaluation unit (trade name: Vibrating Sample Magnetometer VSM-3, manufactured by Toei Industry Co., Ltd.).

EXAMPLES AND COMPARATIVE EXAMPLES

To each of raw material powders shown in Tables 1 and 2, 3.0% by mass of a silicone resin (trade name: SR2414LV, manufactured by Dow Corning Toray Silicone Co., Ltd.) as an insulating resin was added, these were mixed with a pressure kneader and thereafter dried at 90° C. for 30 minutes, and thereby a mixed powder was obtained. The dried mixed powder was passed through a mesh (mesh opening: 355 μm, line diameter: 224 μm), thereafter, 0.3% by mass of zinc stearate (reagent) was added as a lubricant, and thereby a magnetic powder was obtained.

Then, the resulting magnetic powder was packed in a toroidal mold having an outer diameter of 11.0 mm, an inner diameter of 6.5 mm and a thickness of 3.0 mm) and compression molded under a molding pressure shown in Tables 1 and 2, and thereby a toroidal molded body was obtained. Thereafter, the resulting toroidal molded body was put into a thermostat bath and heat treated under the conditions shown in Tables 1 and 2, and thereby a powder magnetic core was obtained.

(Oxygen Content of Powder Magnetic Core)

The oxygen content of the powder magnetic core was measured with an apparatus for analyzing a gas in metal. According to the detection method, a sample was gasified (CO in the case of oxygen) in a graphite crucible and CO was detected with a non-dispersive infrared detector.

(Core Loss of Powder Magnetic Core)

The core loss (magnetic core loss: Pcv) of the powder magnetic core was measured with a B-H analyzer (trade name: SY-8232, manufactured by Iwatsu Electric Co., Ltd.) under the measurement conditions: applied magnetic field Bm=25 mT, and f=100 kHz to 2 MHz. When a measurement at 2 MHz was impossible because of excessive core loss, a numerical value obtained by extrapolating a core loss-frequency correlation of 100 kHz to 1 MHz was used. Furthermore, in particular, when the measurement at 1 MHz was impossible because of excessive core loss, it was determined to be "immeasurable".

(Relative Permeability of Powder Magnetic Core)

The relative permeability of the powder magnetic core was measured with a B-H analyzer (trade name: SY-8232, manufactured by Iwatsu Electric Co., Ltd.) under the measurement conditions: applied magnetic field Bm=25 mT, and f=1 MHz.

(Magnetization Distribution in a Particle of Powder Magnetic Core)

A magnetization distribution in a particle of each of the soft magnetic metal powders used in Examples 3 and 4 was observed with a TEM (trade name: TEM-2100F, manufactured by JEOL Ltd.). As an observation sample, a sample obtained by slicing the powder magnetic core into a flake having a thickness of 100 nm with an FIB processor (trade name: NOVA200, manufactured by FEI Company) was used.

TABLE 1

| | Raw material powder | Average particle size μm | Peak width deg | Oxygen content of core % by mass | Electrical resistivity of core Ωcm | Core loss kW/m³ | Relative permeability of core | Magnetization distribution of particle | Manufacturing conditions: Molding pressure Tonf/cm² | Heat treatment temperature ° C. | Heat treatment atmosphere | Heat treatment time h |
|---|---|---|---|---|---|---|---|---|---|---|---|---|
| Comparative Example 1 | Nanocrystal carbonyl iron powder | 1.5 | 0.65 | 1.99 | 0.966 | 434 | 9.2 | — | 6 | 200 | Air | 0.1 |
| Example 1 | Nanocrystal carbonyl iron powder | 1.5 | 0.66 | 2.24 | 0.344 | 125 | 9.0 | — | 6 | 200 | Air | 0.5 |
| Example 2 | Nanocrystal carbonyl iron powder | 1.5 | 0.65 | 2.86 | 0.297 | 103 | 8.7 | — | 6 | 200 | Air | 1.0 |

TABLE 1-continued

| | Raw material powder | Average particle size μm | Peak width deg | Oxygen content of core % by mass | Electrical resistivity of core Ωcm | Core loss kW/m³ | Relative permeability of core | Magnetization distribution of particle | Manufacturing conditions: Molding pressure Tonf/cm² | Heat treatment temperature ° C. | Heat treatment atmosphere | Heat treatment time h |
|---|---|---|---|---|---|---|---|---|---|---|---|---|
| Comparative Example 2 | Nanocrystal carbonyl iron powder | 1.5 | 0.64 | 1.95 | 0.252 | 353 | 11.1 | — | 15 | 200 | Air | 0.1 |
| Example 3 | Nanocrystal carbonyl iron powder | 1.5 | 0.67 | 2.45 | 0.137 | 163 | 10.3 | — | 15 | 200 | Air | 0.5 |
| Example 4 | Nanocrystal carbonyl iron powder | 1.5 | 0.65 | 2.85 | 0.121 | 65 | 10.2 | Vortex | 15 | 200 | Air | 1.0 |
| Comparative Example 3 | Nanocrystal carbonyl iron powder | 1.5 | 0.65 | 1.46 | 1.802 | 485 | 9.7 | — | 6 | 200 | Ar | 0.1 |
| Comparative Example 4 | Nanocrystal carbonyl iron powder | 1.5 | 0.63 | 1.49 | 0.911 | 422 | 9.8 | — | 6 | 200 | Ar | 0.5 |
| Comparative Example 5 | Nanocrystal carbonyl iron powder | 1.5 | 0.66 | 1.53 | 0.883 | 453 | 9.8 | — | 6 | 200 | Ar | 1.0 |
| Comparative Example 6 | Nanocrystal carbonyl iron powder | 1.5 | 0.65 | 1.59 | 1.009 | 668 | 10.6 | — | 12 | 150 | Air | 0.1 |
| Comparative Example 7 | Nanocrystal carbonyl iron powder | 1.5 | 0.64 | 1.69 | 0.665 | 634 | 10.4 | — | 12 | 150 | Air | 0.5 |
| Comparative Example 8 | Nanocrystal carbonyl iron powder | 1.5 | 0.64 | 1.76 | 0.629 | 559 | 10.5 | — | 12 | 150 | Air | 1.0 |
| Example 5 | Nanocrystal carbonyl iron powder | 1.5 | 0.64 | 2.56 | 0.343 | 53 | 9.3 | Vortex | 12 | 150 | Air | 60 |
| Example 6 | Nanocrystal carbonyl iron powder | 1.5 | 0.63 | 2.70 | 0.223 | 190 | 9.4 | — | 12 | 150 | Air | 140 |
| Comparative Example 9 | Nanocrystal carbonyl iron powder | 1.5 | 0.65 | 1.96 | 0.336 | 451 | 10.6 | — | 12 | 200 | Air | 0.1 |
| Example 7 | Nanocrystal carbonyl iron powder | 1.5 | 0.65 | 2.39 | 0.173 | 183 | 9.8 | — | 12 | 200 | Air | 0.5 |
| Example 8 | Nanocrystal carbonyl iron powder | 1.5 | 0.66 | 2.66 | 0.132 | 110 | 9.4 | — | 12 | 200 | Air | 1.0 |

Each of the powder magnetic cores of Examples 1 to 8 was confirmed to be a powder magnetic core having a core oxygen content of 2.0% by mass or more, and to be low in the core loss and high in the electrical resistivity of the core. It was confirmed that by conducting the heat treatment at a heat treatment temperature less than 250° C., the powder magnetic core having the oxygen content of 2.0% by mass or more can be obtained with good controllability. On the other hand, each of powder magnetic cores of Comparative Examples 1 to 9 was confirmed to be a powder magnetic core having a core oxygen content less than 2.0% by mass and large core loss. Each of the powder magnetic cores of Comparative Examples 1, 2, and 6 to 9 was confirmed to be a powder magnetic core which was not sufficiently oxidized (low in the oxygen content) and large in the core loss because the heat treatment temperature or the heat treatment time was not sufficient. Each of the powder magnetic cores of Comparative Examples 3 to 5 was confirmed to be large in the core loss because the powder magnetic core was heat treated under an argon atmosphere and not sufficiently oxidized.

Furthermore, when the structure of soft magnetic metal powders used in Examples 4 and 5, which were relatively low in the core loss among Examples was investigated, all was confirmed to have a vortex magnetization distribution.

TABLE 2

| | Raw material powder | Average particle size μm | Peak half value width deg | Core loss kW/m³ | Manufacturing conditions: Molding pressure Tonf/cm² | Heat treatment temperature ° C. | Heat treatment atmosphere | Heat treatment time h |
|---|---|---|---|---|---|---|---|---|
| Comparative Example 10 | Nanocrystal carbonyl iron powder | 9.5 | 0.65 | 1023 | 6 | 200 | Air | 1.0 |
| Comparative Example 11 | Nanocrystal carbonyl iron powder | 0.3 | 0.66 | 1550 | 6 | 200 | Air | 1.0 |

TABLE 2-continued

| | Raw material powder | Average particle size μm | Peak half value width deg | Core loss kW/m$^3$ | Manufacturing conditions: Molding pressure Tonf/cm$^2$ | Heat treatment temperature ° C. | Heat treatment atmosphere | Heat treatment time h |
|---|---|---|---|---|---|---|---|---|
| Comparative Example 12 | Non-nanocrystal carbonyl iron powder | 2.7 | 0.15 | 628 | 6 | 200 | Air | 1.0 |
| Comparative Example 13 | Atomized iron powder | 3.8 | 0.04 | 1006 | 6 | 200 | Air | 1.0 |
| Comparative Example 14 | Atomized iron powder | 21.2 | 0.04 | 4071 | 6 | 200 | Air | 1.0 |
| Comparative Example 15 | Reduced iron powder | 1.1 | 0.04 | 1452 | 6 | 200 | Air | 1.0 |
| Comparative Example 16 | Atomized Fe—Ni based powder | 4.3 | 0.09 | 1053 | 6 | 200 | Air | 1.0 |
| Comparative Example 17 | Atomized Fe—Ni based powder | 9.2 | 0.06 | 1161 | 6 | 200 | Air | 1.0 |
| Comparative Example 18 | Atomized Fe—Ni based powder | 14.7 | 0.05 | 1291 | 6 | 200 | Air | 1.0 |
| Comparative Example 19 | Atomized Fe—Ni based powder | 26.5 | 0.05 | 2357 | 6 | 200 | Air | 1.0 |
| Comparative Example 20 | Atomized Fe—Si based powder | 4.6 | 0.09 | 1016 | 6 | 200 | Air | 1.0 |
| Comparative Example 21 | Atomized Fe—Si based powder | 14.1 | 0.07 | 1516 | 6 | 200 | Air | 1.0 |
| Comparative Example 22 | Atomized Fe—Si—Al based powder | 19.6 | 0.09 | 1830 | 12 | 200 | $N_2$ | 1.0 |

As shown in Table 2, each of the powder magnetic cores of Comparative Examples 10 to 22, which does not satisfy the conditions of an average particle size (D50) of 0.5 to 5 μM, and the half width of diffraction peak in the <110> direction of α-Fe as measured by X-ray powder diffraction of 0.2 to 5.0° was confirmed to be large in the core loss. Each of the powder magnetic cores of Comparative Examples 10, 14, 17 to 19, 21 and 22 was too large in the average particle size and confirmed to be large in the eddy current loss and core loss. The powder magnetic core of Comparative Example 11 was too small in the average particle size to sufficiently disperse the binder resin and was confirmed to be large in the core loss. Each of the powder magnetic cores of Comparative Examples 12 to 22 was small in the half width of diffraction peak in the <110> direction of α-Fe in measurement of the powder magnetic core by X-ray diffractometry, that is, too large in the average crystallite size and thus was confirmed to be large in the hysteresis loss and core loss.

<Relationship Between Core Loss and Frequency Dependency>

The powder magnetic cores of Example 4, Comparative Examples 11, 12, 14, 15, 17, 19 and 21 were further studied of the frequency dependency. The core loss (magnetic core loss: Pcv) of the powder magnetic core was measured with a BH analyzer (trade name: SY-8232, manufactured by Iwatsu Electric Co., Ltd.) under the measurement conditions of applied magnetic field Bm=25 mT, and f=100 kHz to 2 MHz. When a measurement at 2 MHz was impossible because of excessive core loss, a numerical value obtained by extrapolating a core loss-frequency correlation of 100 kHz to 1 MHz was used. Furthermore, in particular, when the measurement at 1 MHz was impossible because of excessive core loss, it was determined to be "immeasurable". These results are illustrated in FIG. 1. As illustrated in FIG. 1, the powder magnetic core of Example 4 was confirmed to be low in the core loss over an entire frequency region. On the other hand, each of the powder magnetic cores of Comparative Examples 11, 12, 14, 15, 17, 19 and 21 was large in the frequency dependency and confirmed to be larger in the core loss as the frequency becomes larger.

The powder magnetic core of the present invention and a method for manufacturing the same, which can reduce the core loss over from a low frequency region to a high frequency band, are broadly applicable to electric and magnetic devices such as inductors and various kinds of transformers and various kinds of devices, apparatuses and systems provided therewith.

What is claimed is:

1. A powder magnetic core, comprising:

a soft magnetic metal powder having an average particle size (D50) of 0.5 to 5 μm, a half width of diffraction peak in a <110> direction of α-Fe as measured by X-ray powder diffraction of 0.2 to 5.0°, and an Fe content of 97.0% by mass or more, the core having an oxygen content of 2.0% by mass or more.

2. The powder magnetic core according to claim 1, wherein a carbon content of the soft magnetic metal powder is from 0.1 to 1.5% by mass.

3. The powder magnetic core according to claim 1, wherein a saturation magnetization as of the soft magnetic metal powder is 200 emu/g or more.

4. The powder magnetic core according to claim 1, further comprising:

an insulating resin that at least partially coats a surface of the soft magnetic metal powder at a thickness of 10 to 1000 nm.

5. The powder magnetic core according to claim 1, wherein the soft magnetic metal powder has a vortex magnetization distribution.

6. The powder magnetic core according to claim 1, wherein an electrical resistivity is 0.05 Ωcm or more.

7. The powder magnetic core according to claim 2, wherein a saturation magnetization as of the soft magnetic metal powder is 200 emu/g or more.

8. The powder magnetic core according to claim 2, further comprising:

an insulating resin that at least partially coats a surface of the soft magnetic metal powder at a thickness of 10 to 1000 nm.

9. The powder magnetic core according to claim 2, wherein the soft magnetic metal powder has a vortex magnetization distribution.

10. The powder magnetic core according to claim 2, wherein an electrical resistivity is 0.05 Ωcm or more.

* * * * *